US006405097B1

(12) United States Patent
Asano

(10) Patent No.: US 6,405,097 B1
(45) Date of Patent: Jun. 11, 2002

(54) OPERATION DATA PROCESSING DEVICE

(75) Inventor: Fumiaki Asano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/960,920

(22) Filed: Sep. 25, 2001

(30) Foreign Application Priority Data

Oct. 3, 2000 (JP) ..... 2000-303388

(51) Int. Cl.[7] ..... G06F 19/00; D05B 19/02

(52) U.S. Cl. ..... 700/138; 112/470.02; 112/278; 112/445

(58) Field of Search ..... 700/138, 136, 700/137; 112/470.02, 470.01, 470.05, 470.06, 102.5, 475.19, 273, 278, 445, 155

(56) References Cited

U.S. PATENT DOCUMENTS 5,881,657 A * 3/1999 Asano ..... 700/138 X
6,167,823 B1 * 1/2001 Laufer et al. ..... 112/102.5

FOREIGN PATENT DOCUMENTS

JP A 10-272271 10/1998

* cited by examiner

*Primary Examiner*—Peter Nerbun
(74) *Attorney, Agent, or Firm*—Oliff & Berridge, PLC

(57) ABSTRACT

An operation data processing device that summarizes trouble situations that occur during sewing operations. A log data storing device generates and stores log data based on an operation state of pattern sewing machines. A trouble summarizing device summarizes trouble information that occurs during operations. The trouble information is then summarized in association with a stitch number based on the stored log data. A displaying device visualizes the trouble information in a manner that allows a user to easily determine a trouble location and frequency for a given sewing pattern.

19 Claims, 16 Drawing Sheets

```
MACHINE: AAAAAA                                                                                    100
DATE    TIME    OPERATION
1997/02/01      09:13:33        POWER ON
1997/02/01      09:13:40          READ PATTERN FUN3   STITCH NO.=0004325
1997/02/01      19:15:34        SEWING START  101
1997/02/01      09:20:40          COLOR CHANGE  NEW NEEDLE BAR NO.=02  STITCH NO.=0001203
1997/02/01      10:04:40  102     COLOR CHANGE  NEW NEEDLE BAR NO.=03  STITCH NO.=0001203
1997/02/01      10:05:50          COLOR CHANGE  NEW NEEDLE BAR NO.=04  STITCH NO.=0001403
1997/02/01      10:10:50          BUTTON STOP
1997/02/01      10:14:34          SEWING RESTART
1997/02/01      10:15:50          THREAD BREAKAGE HEAD NO.=01  NEEDLE BAR NO.=01 STITCH NO.=0001403  SPEED RANGE=04
1997/02/01      10:17:34  103     SEWING RESTART
1997/02/01      10:20:34        END
1997/02/01      11:23:29        POWER OFF
1997/02/02      19:13:33        POWER ON
1997/02/02      19:13:40          READ PATTERN FUN3   STITCH NO.=0004325
1997/02/02      19:15:34        SEWING START
1997/02/02      19:20:40          COLOR CHANGE  NEW NEEDLE BAR NO.=02  STITCH NO.=0001203
1997/02/02      20:04:40          COLOR CHANGE  NEW NEEDLE BAR NO.=03  STITCH NO.=0001203
1997/02/02      20:05:50          COLOR CHANGE  NEW NEEDLE BAR NO.=04  STITCH NO.=0001403
1997/02/02      20:10:50          BUTTON STOP
1997/02/02      20:14:34          SEWING RESTART
1997/02/02      20:15:50          THREAD BREAKAGE HEAD NO.=01  NEEDLE BAR NO.=01 STITCH NO.=0001403  SPEED RANGE=04
1997/02/02      20:17:34          SEWING RESTART
1997/02/02      20:18:50          THREAD BREAKAGE HEAD NO.=01  NEEDLE BAR NO.=01 STITCH NO.=0001403  SPEED RANGE=04
1997/02/02      20:20:34          SEWING RESTART
1997/02/02      20:22:34        END
1997/02/02      20:24:50        POWER OFF
```

FIG. 10

STITCH NUMBER-THREAD BREAKAGE LIST

| STITCH NUMBER | ATTRIBUTE | PITCH LENGTH (MM) | NO. OF TIMES OF THREAD BREAKAGE |
|---|---|---|---|
| 1 | FEED | 0.0 | 0 |
| 2 | FEED | 5.0 | 0 |
| 3 | STITCH | 2.3 | 0 |
| 4 | STITCH | 5.0 | 0 |
| 5 | STITCH | 5.0 | 0 |
| 6 | STITCH | 4.9 | 0 |
| 7 | STITCH | 4.8 | 0 |
| 8 | STITCH | 1.1 | 1 |
| 9 | STITCH | 0.7 | 2 |
| 10 | STITCH | 1.5 | 0 |
| 11 | STITCH | 1.2 | 0 |
| 12 | COLOR CHANGE | - | 0 |
| 13 | STITCH | 1.2 | 0 |
| 14 | STITCH | 1.3 | 0 |
| 15 | STITCH | 0.2 | 5 |
| 16 | STITCH | 0.6 | 2 |
| 17 | STITCH | 1.2 | 0 |
| 18 | FEED | 1.4 | 0 |
| 19 | STITCH | 1.5 | 0 |
| 20 | STITCH | 1.4 | 0 |
| 21 | STITCH | 3.2 | 0 |
| 22 | STITCH | 3.2 | 0 |
| 23 | STITCH | 1.0 | 0 |
| 24 | END | - | 0 |

FIG. 11

| NO. | NO. OF TIMES OF THREAD BREAKAGE | MARK TO BE DISPLAYED |
|---|---|---|
| 1 | 1 | × |
| 2 | 2-3 | ◆ |
| 4 | 4 or more | ● |

FIG. 15

100

MACHINE: AAAAAA

| DATE | TIME | OPERATION |
|---|---|---|
| 1997/02/01 | 09:13:33 | POWER ON |
| 1997/02/01 | 09:13:40 | READ PATTERN FUN3 STITCH NO.=0004325 |
| 1997/02/01 | 19:15:34 | SEWING START 101 |
| 1997/02/01 | 09:20:40 | COLOR CHANGE NEW NEEDLE BAR NO.=02 STITCH NO.=0001203 |
| 1997/02/01 | 10:04:40 | 102 COLOR CHANGE NEW NEEDLE BAR NO.=03 STITCH NO.=0001203 |
| 1997/02/01 | 10:05:50 | COLOR CHANGE NEW NEEDLE BAR NO.=04 STITCH NO.=0001403 |
| 1997/02/01 | 10:10:50 | BUTTON STOP |
| 1997/02/01 | 10:14:34 | SEWING RESTART |
| 1997/02/01 | 10:15:50 | THREAD BREAKAGE HEAD NO.=01 NEEDLE BAR NO.=01 STITCH NO.=0001403 SPEED RANGE=04 |
| 1997/02/01 | 10:17:34 | 103 SEWING RESTART |
| 1997/02/01 | 10:20:34 | END |
| 1997/02/01 | 11:23:29 | POWER OFF |
| 1997/02/02 | 19:13:33 | POWER ON |
| 1997/02/02 | 19:13:40 | READ PATTERN FUN3 STITCH NO.=0004325 |
| 1997/02/02 | 19:15:34 | SEWING START |
| 1997/02/02 | 19:20:40 | COLOR CHANGE NEW NEEDLE BAR NO.=02 STITCH NO.=0001203 |
| 1997/02/02 | 20:04:40 | COLOR CHANGE NEW NEEDLE BAR NO.=03 STITCH NO.=0001203 |
| 1997/02/02 | 20:05:50 | COLOR CHANGE NEW NEEDLE BAR NO.=04 STITCH NO.=0001403 |
| 1997/02/02 | 20:10:50 | BUTTON STOP |
| 1997/02/02 | 20:14:34 | SEWING RESTART |
| 1997/02/02 | 20:15:50 | THREAD BREAKAGE HEAD NO.=01 NEEDLE BAR NO.=01 STITCH NO.=0001403 SPEED RANGE=04 |
| 1997/02/02 | 20:17:34 | SEWING RESTART |
| 1997/02/02 | 20:18:50 | THREAD BREAKAGE HEAD NO.=01 NEEDLE BAR NO.=01 STITCH NO.=0001403 SPEED RANGE=04 |
| 1997/02/02 | 20:20:34 | SEWING RESTART |
| 1997/02/02 | 20:22:34 | END |
| 1997/02/02 | 20:24:50 | POWER OFF |

PRIOR ART

OPERATION DATA PROCESSING DEVICE

BACKGROUND OF THE INVENTION

1. Field of Invention

This invention relates to an operation data processing device for controlling an operation state of a sewing production system intended for embroidery machines.

2. Description of Related Art

The use of production systems with embroidery machines to sew various patterns is well known in the prior art. In one example, a production system, on which several embroidery machines are operated, can record operations performed by each embroidery machine in log files to manage an operation state of each embroidery machine. Based on the log files, operation data, such as productivity and rate of operation on each embroidery machine, is made and used as management data. In a system disclosed in Japanese Laid-Open Patent Publication No. 10-272271, a log file 100 is recorded as shown in FIG. 15. The log file 100 stored the contents of operations of a sewing machine named AAAAAA, performed from Feb. 1 to Feb. 2 of 1997.

In the log file 100, embroidery steps are recorded, such as a sewing start 101, a color change 102 and a trouble situation, such as a thread breakage 103. In addition to thread breakage, examples of trouble related to thread are a bobbin thread tangle and a thread wiping error.

Thread breakage can be a frequent problem with embroidery machines. Every time thread is broken on an embroidery machine, the operator must restore the embroidery machine to a normal state of operation. Therefore, a log file, which may store records of a week or a month, is investigated to count the number of times thread breakage has occurred on a particular pattern. This information is later used for product control.

FIG. 16 shows an example of a conventional summary table 110 illustrating the occurrence of thread breakage 103 when a pattern "Fun3 " is embroidered. The summary table 110 indicates that thread breakage occurred at the 1403rd stitch for a first time and a second time of embroidering, respectively. Additionally, it indicates that thread breakage occurred at the 1402nd stitch for a third time of embroidering. It is apparent from the summary table 110 that thread breakage is liable to occur at the 1402nd stitch of the pattern "Fun3".

However, the summary table 110 only shows a position where the thread breakage is likely to occur by stitch numbers. It is difficult for the user to manage embroidery machines in operation by stitch numbers only, which are just enumerated on a management display screen. Because the conventional summary table 110 does not link a sewing position to a stitch number, it is difficult to find where the sewing position is located in the pattern, and thus determine a point where thread breakage is likely to occur. In addition, when sewing pattern data is processed into stitch data, it is difficult to detect which piece of stitch data has a problem.

In a sewing order, two stitches may be positioned close to each other, although their sewing order numbers are far apart. In the summary table 110, it is impossible to find such a positional relationship. For example, if the occurrence of thread breakage can be decreased through a minor correction of stitch positions, the positional relationship must be found. Because the results obtained from the summary table 110 do not indicate a positional relationship, they cannot be fully utilized for later production control.

SUMMARY OF THE INVENTION

This invention provides an operation data processing device that summarizes trouble situations which occur during sewing and displays problems in association with stitch numbers for future production control.

This invention provides an operation data processing device that processes operation data for pattern sewing operations performed by at least one pattern sewing machine. It includes a log data storing device that generates and stores log data based on an operation state of the pattern sewing machine. It also includes a trouble summarizing device that summarizes trouble information pertaining to sewing operations, which occur on the pattern sewing machine during operation. The trouble data is summarized in association with a stitch number based on the log data stored in the log data storing device. A displaying device visualizes the trouble information, summarized via the trouble summarizing device in association with the stitch number.

Operation log data of the sewing machines is stored by the log data storing device, and trouble data is summarized in association with the stitch numbers by the trouble summarizing device based on the log data. The log data includes not only the trouble information, but also various events of operations associated with the stitch numbers. Of the log data, trouble related to thread breakage, for example, is summarized by the trouble summarizing device. Further, as the summarized trouble information is visualized by the displaying device, a trouble place and trouble frequency may easily be grasped. Therefore, such information may be utilized for later production control.

These and other features and advantages of this invention are described in or apparent from the following detailed description of the preferred embodiments.

BRIEF DESCRIPTION OF THE DRAWINGS

The invention will be described with reference to the accompanying drawings in which like elements are labeled with like numbers and in which:

FIG. 10 shows a stitch number-thread breakage list;

FIG. 11 shows varieties of marks allocated according to the number of thread breakage occurrences;

FIG. 15 shows an exemplary log data file of the prior art; and

DETAILED DESCRIPTION OF PREFERRED EMBODIMENTS

Figure 1:
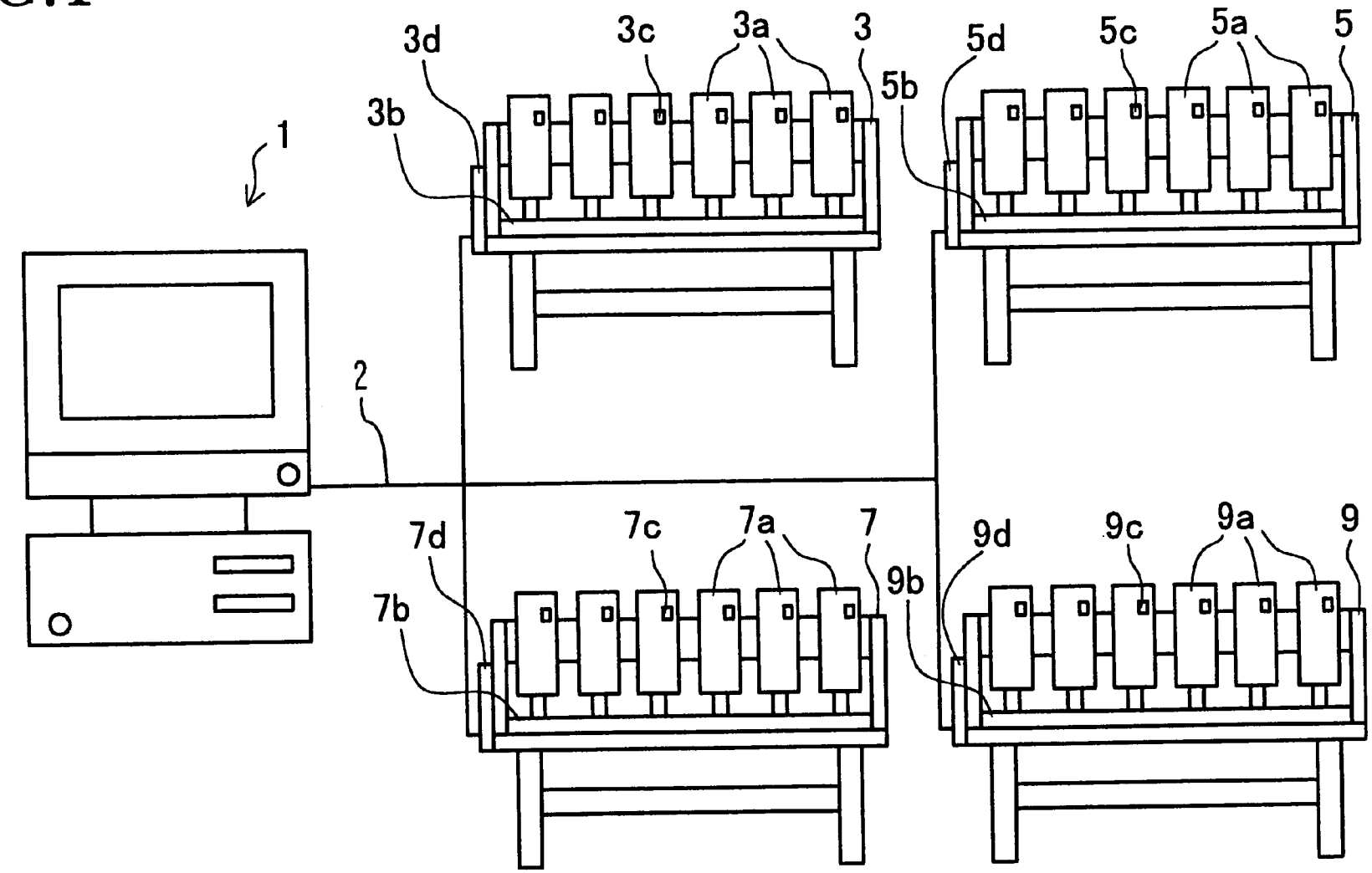
FIG. 1 is a schematic construction of a pattern sewing machine system according to an exemplary embodiment of the invention.

FIG. 1 is a schematic illustration of a pattern sewing machine system according to one embodiment of the invention. The pattern sewing machine system includes a personal computer 1 and a plurality of embroidery machines 3, 5, 7, 9. The embroidery machines 3, 5, 7, 9 are connected to the personal computer 1 via a communication cable 2. It should be noted that although four embroidery machines are illustrated according to this embodiment, the number of the embroidery machines is not limited to this number.

The embroidery machine 3 has a plurality of heads 3*a*, a work piece holding frame 3*b*, and a control unit 3*d*. The heads 3*a* perform embroidering on respective work pieces held by the work piece holding frame 3*b*. Each of the heads 3*a* and the work piece holding frame 3*b* are controlled by the control unit 3*d*. Each head 3*a* is provided with a stop switch 3*c*, to stop the operation of the head manually. The other embroidery machines 5, 7, 9 have the same structure as the embroidery machine 3.

Figure 2:
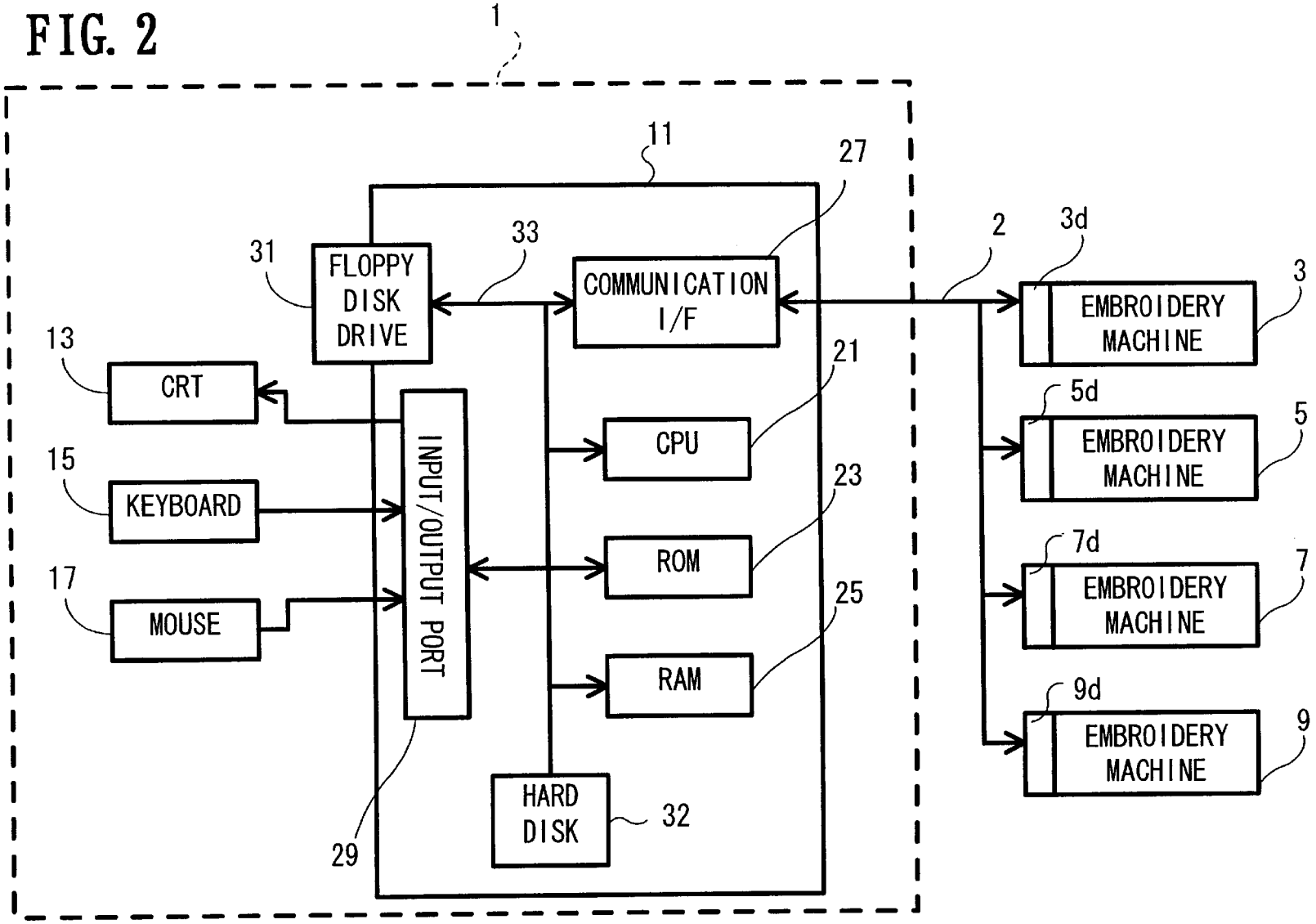
FIG. 2 is a block diagram illustrating a control system of a personal computer employed in the pattern sewing machine system shown in FIG. 1.

FIG. 2 is a block diagram illustrating a control system of the personal computer 1 shown in FIG. 1. The personal computer 1 is structured in such a manner that a CRT 13, a keyboard 15, and a mouse 17 are connected to a body 11. The body 11 is provided with a CPU 21, a ROM 23, and a RAM 25, which control the operation. The body 11 is further provided with a communication interface (I/F) 27 for communicating with the control units 3*d*, 5*d*, 7*d*, 9*d*, of each embroidery machine 3, 5, 7, 9. This is accomplished via the cable 2, an input/output port for transmitting and receiving data among the CRT 13, the keyboard 15, and the mouse 17, a floppy disk drive 31. and a hard disk 32. The CPU 21, the ROM 23, the RAM 25, the communication I/F 27, the input/output port 29, the floppy disk drive 31, and the hard disk 32 are connected to each other via a bus 33, so as to transmit and receive data among them.

To perform embroidering with the pattern sewing machine system, the personal computer 1 reads pattern data from the floppy disk drive 31 or the hard disk 32 and transmits the pattern data along with work instruction information to the control units 3*d*, 5*d*, 7*d*, 9*d* of each embroiders machine 3, 5, 7, 9 via the communication cable 2. In the control units 3*d*, 5*d*, 7d, 9*d*, each of the heads 3*a*, 5*a*, 7*a*, 9*a* and the work piece holding frames 3*b*, 5*b*, 7*b*, 9*b* are controlled to perform sewing operations based on the work instruction.

At this time, each of the control units 3*d*, 5*d*, 7*d*, 9*d* transmits, to the personal computer 1, operation condition data, including each job content and the on/off state of each of the stop switches 3*c*, 5*c*, 7*c*, 9*c* along with identification numbers of each machine 3, 5, 7, 9. The operation condition data includes the contents stored in the conventional log data, such as date, time, embroidery pattern, stitch number, and sewing job. When a trouble situation such as thread breakage occurs, the type of trouble, head number, needle bar number, and stitch number (the place where the trouble occurred) are transmitted as operation condition data. The computer 1 receives the operation condition data and sequentially records it in the hard disk 32, or a floppy disk set in the floppy disk drive 31 as log data.

After an operation allocated for a fixed time is finished, it is preferable to analyze the information pertaining to a trouble situation during the operation and summarize the information for subsequent operations. Therefore, the computer 1 analyzes and summarizes the information on the trouble situation, which has occurred during a set time period. The computer analyzes the information, from log data that has stored the operation condition data for the set time period. The computer then executes a trouble information display process for displaying trouble information on the CRT 13 in a way that is easy to understand.

An especially crucial problem is thread breakage. A flowchart showing a thread breakage information displaying process is shown in FIGS. 3 to 9. This process is executed as necessary according to the instruction from the user. Trouble information on other problems can be displayed in a similar manner.

Figure 3:
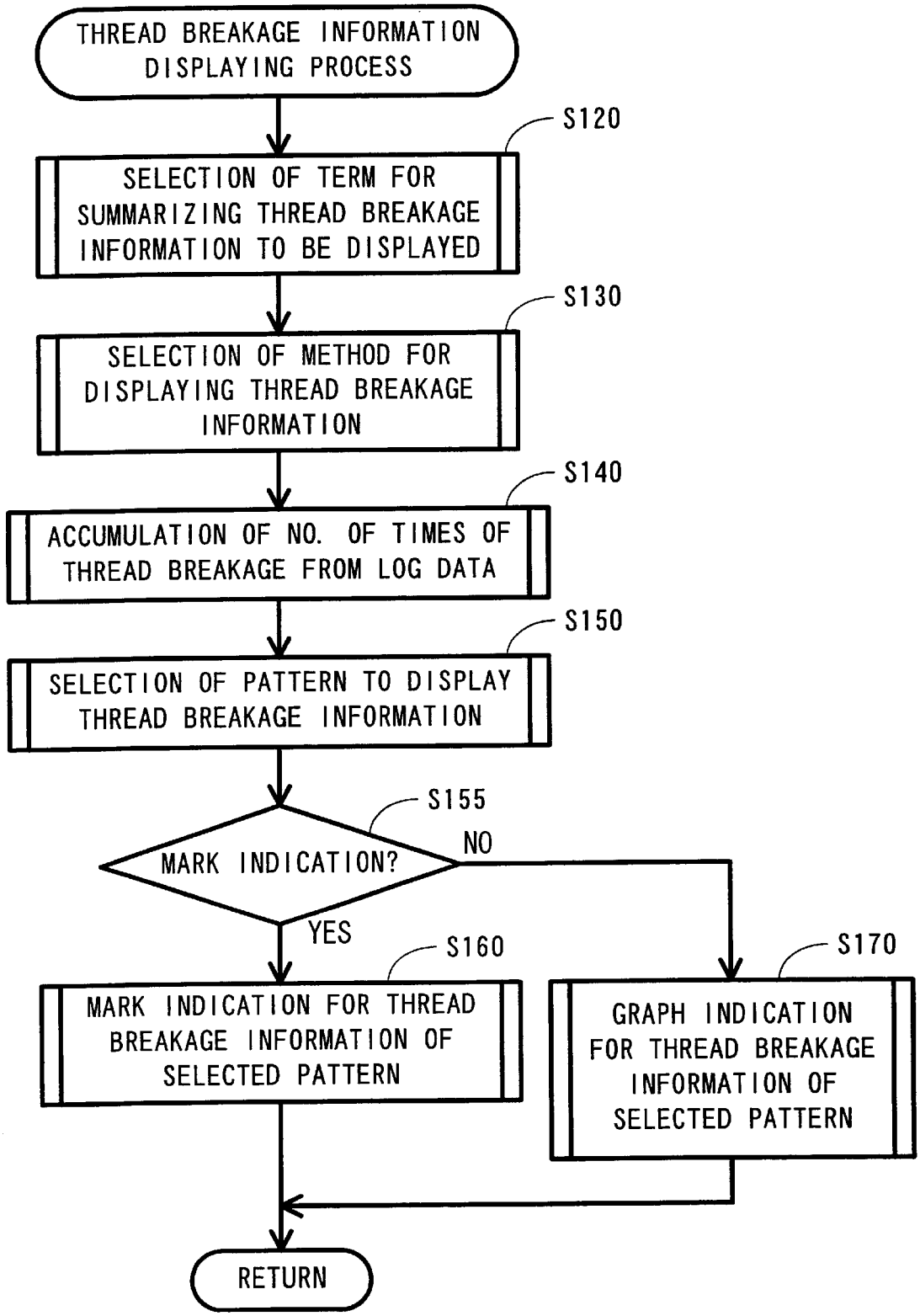
FIG. 3 is a main flowchart showing a main routine for displaying thread breakage information.

When execution of the thread breakage information displaying process is instructed by the user, the personal computer 1 executes the following steps of a main routine shown sequentially in FIG. 3. First, the computer 1 selects a term for summarizing the thread breakage information to be displayed on the CRT 13 in step 120. (Hereinafter, step is abbreviated as S.) Then, the computer 1 selects a method for displaying a thread breakage position on the CRT 13 from a mark indication on a pattern, graph indication, or other indication (S130). The computer 1 accumulates the number of times thread breakage has occurred from log data, including the thread breakage information during the selected term according to each embroidery pattern (S140). The computer 1 selects an embroidery pattern to display the thread breakage information on the CRT 13 (S150). If the computer 1 determines that the mark indication is selected (S155: Yes), it displays thread breakage marks on the selected pattern (S160). Alternately, if the computer 1 determines that the graph indication is selected (S155: No), it displays the thread breakage information in a graphical form (S170). Each step will be described in detail in the following subroutines.

Figure 4:
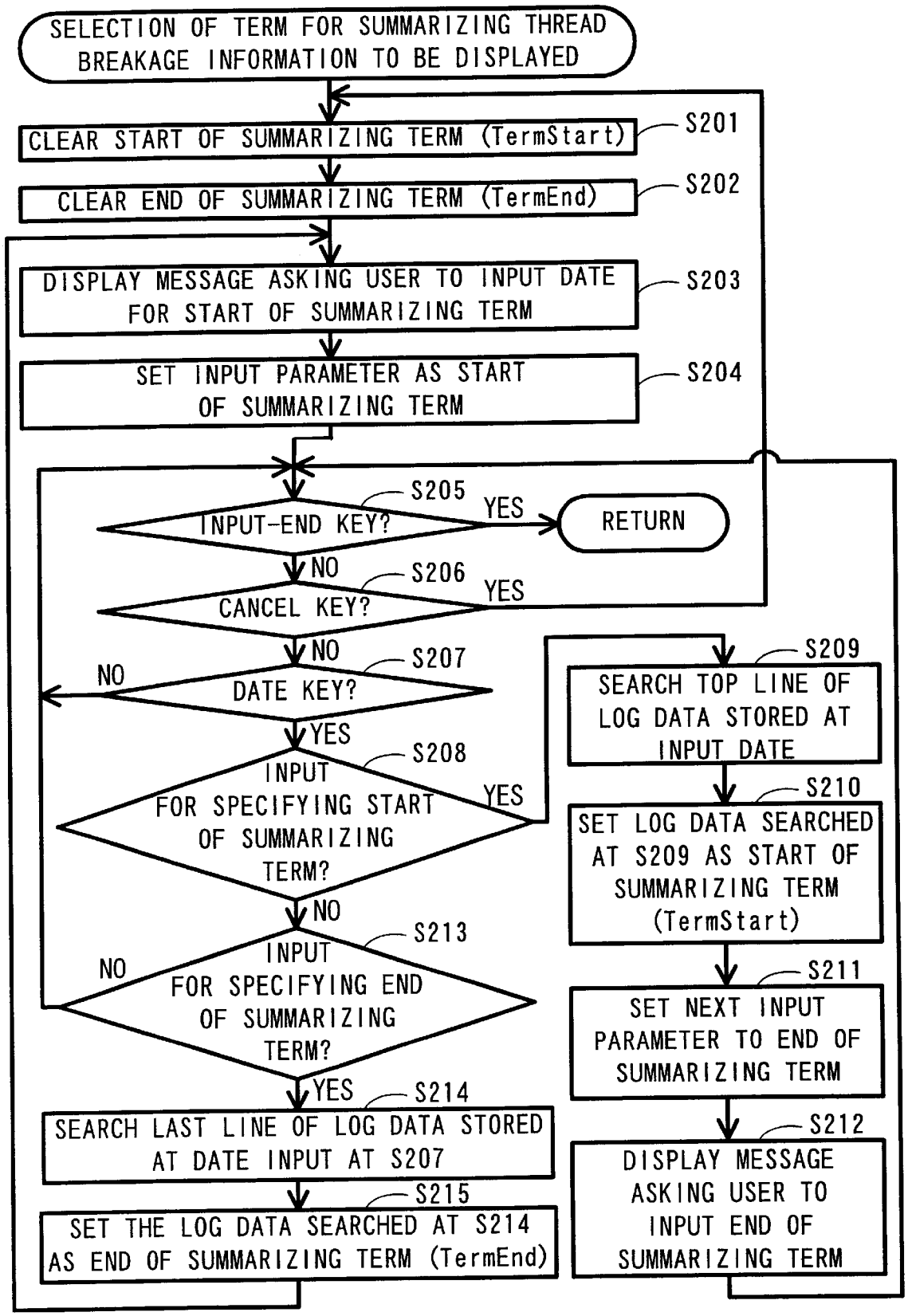
FIG. 4 is a flowchart showing a program for selecting a term for summarizing the thread breakage information to be displayed.

In S120 of the main routine, a subroutine is performed of selecting a term for summarizing the thread breakage information shown in FIG. 4. When this subroutine is executed, the computer 1 clears the start of the term of summarizing (TermStart) (S201), and the end of the term of summarizing (TermEnd) (S202). Then the computer 1 displays a message asking the user to input a date for the start of the term for summarizing the thread breakage information, for example, log data to start summarizing the thread breakage information on the CRT 13 (S203). The computer 1 sets a parameter to be input as the start of the term of summarizing (S204).

The computer 1 waits until any key is pressed by the user. If any key is pressed, the computer determines whether an input-end key is pressed (S205). The input-end key is pressed by the user when all selections regarding a term for summarizing the thread breakage information is completed. At this time, if the input is still continued, the input-end key is not pressed (S205: No). Then, the computer 1 determines whether a cancel key is pressed (S206). The cancel key is pressed by the user when the user clears information entered in progress. When the cancel key is pressed (S206: Yes), the computer 1 returns to the top of the routine and restarts from clearing the start of the term for summarizing the thread breakage information (S201).

The computer 1 determines whether a date key is pressed (S207). At this time, the computer 1 needs date data regarding the start of the term for summarizing. If the date key is not pressed (S207: No), there is no valid input and the computer 1 waits again for another key entry. When the date key is pressed (S207: Yes), the computer 1 determines whether the input is made for specifying the start of the term for summarizing (S208). Since the first date input is conducted for specifying the start of the term for summarizing (S208: Yes), the computer 1 searches the top line of log data stored at the input date (S209). The computer 1 sets the log data searched at S209 as the start of the term for summarizing (TermStart) (S210). The computer 1 sets a parameter to be input next as the end of the term for summarizing (S211). The computer 1 displays a message asking the user to input the end of the term for summarizing on the CRT (S212), and goes into a wait state.

The computer 1 waits until any of the input-end key (S205), the cancel key (S206) and the date key (S207) are pressed. When the date key is pressed (S207: Yes), this key entry is not for the start of the term for summarizing (S208: No), but for the end of the term for summarizing (S213: Yes), and the computer 1 searches the last line of log data stored at the date input at S207 (S214). The computer 1 sets the log data searched at S214 as the end of the term for summarizing (TermEnd) (S215). Then, the computer 1 goes back to S203. When the input-end key is pressed (S205: Yes), the computer 1 finishes the subroutine and returns to the main routine.

Figure 5:
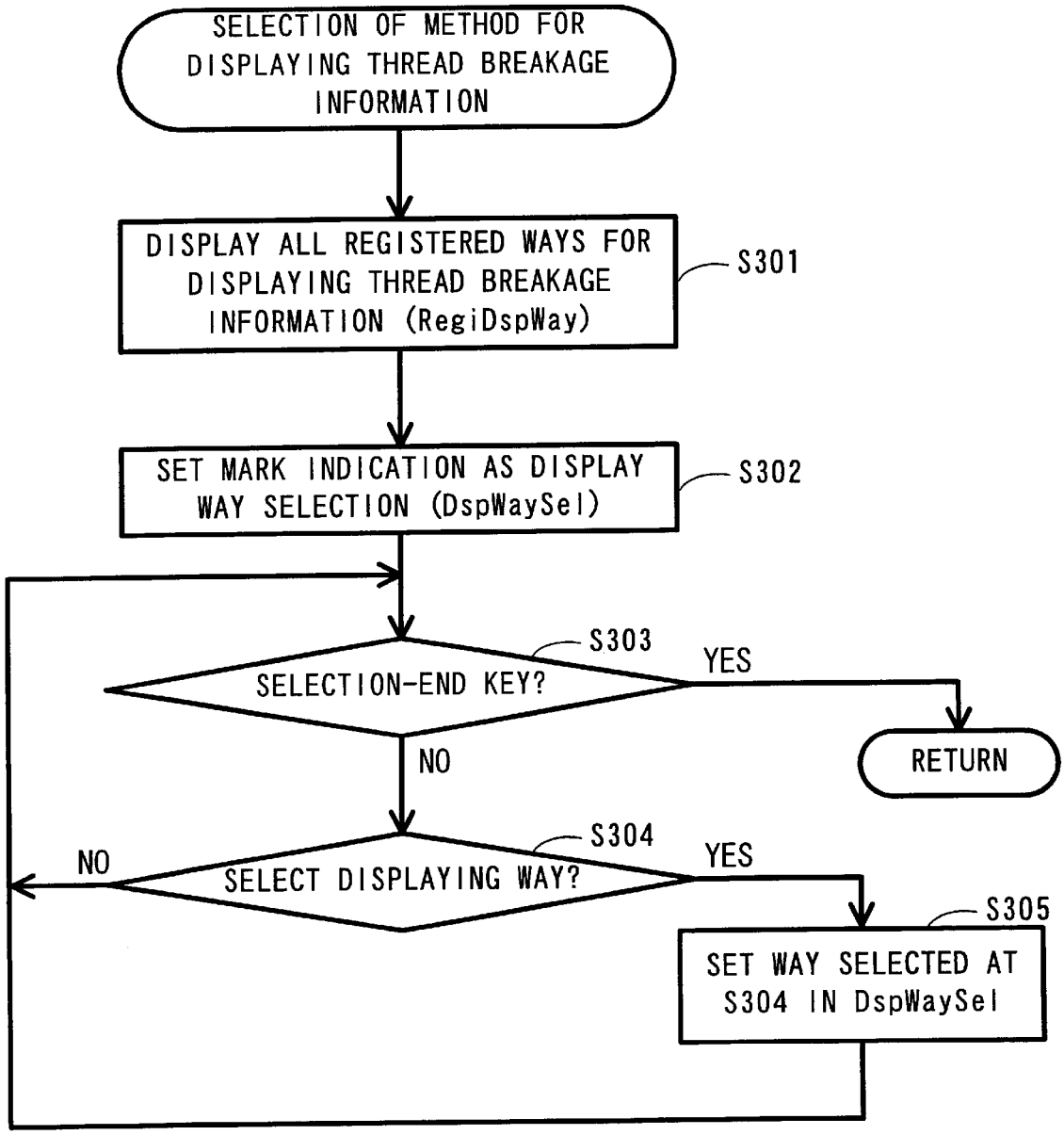
FIG. 5 is a flowchart showing a program for selecting a method for displaying the thread breakage information.

In S130 of the main routine, a subroutine is performed of selecting a way for displaying the thread breakage information, as shown in FIG. 5. When this subroutine is executed, the computer 1 displays all the registered ways for displaying the thread breakage information (RegiDspWay) on the CRT 13 (S301). In this embodiment, thread breakage information may be displayed in three ways: a mark indication, where marks are placed in a pattern; a graph indication, where a vertical axis represents the number of stitches and a horizontal axis represents the number of times thread breakage has occurred; and a text indication, where the thread breakage information is displayed by text, as with the log data.

The computer 1 sets the mark indication as a display way selection (DspWaySel) by default (S302), it then determines whether a selection-end key is pressed (S303). When the selection is finished (S303: Yes), the computer 1 returns to the main routine. If the selection is still continued (S303: No), the computer 1 waits until a desired display way is selected (S304). When the desired display way is selected (S304: Yes), the computer 1 sets the way as the display way selection (DspWaySel) (S305). When the selection-end key is pressed (S303: Yes), the computer 1 finishes the subroutine and goes back to the main routine.

Figure 6:
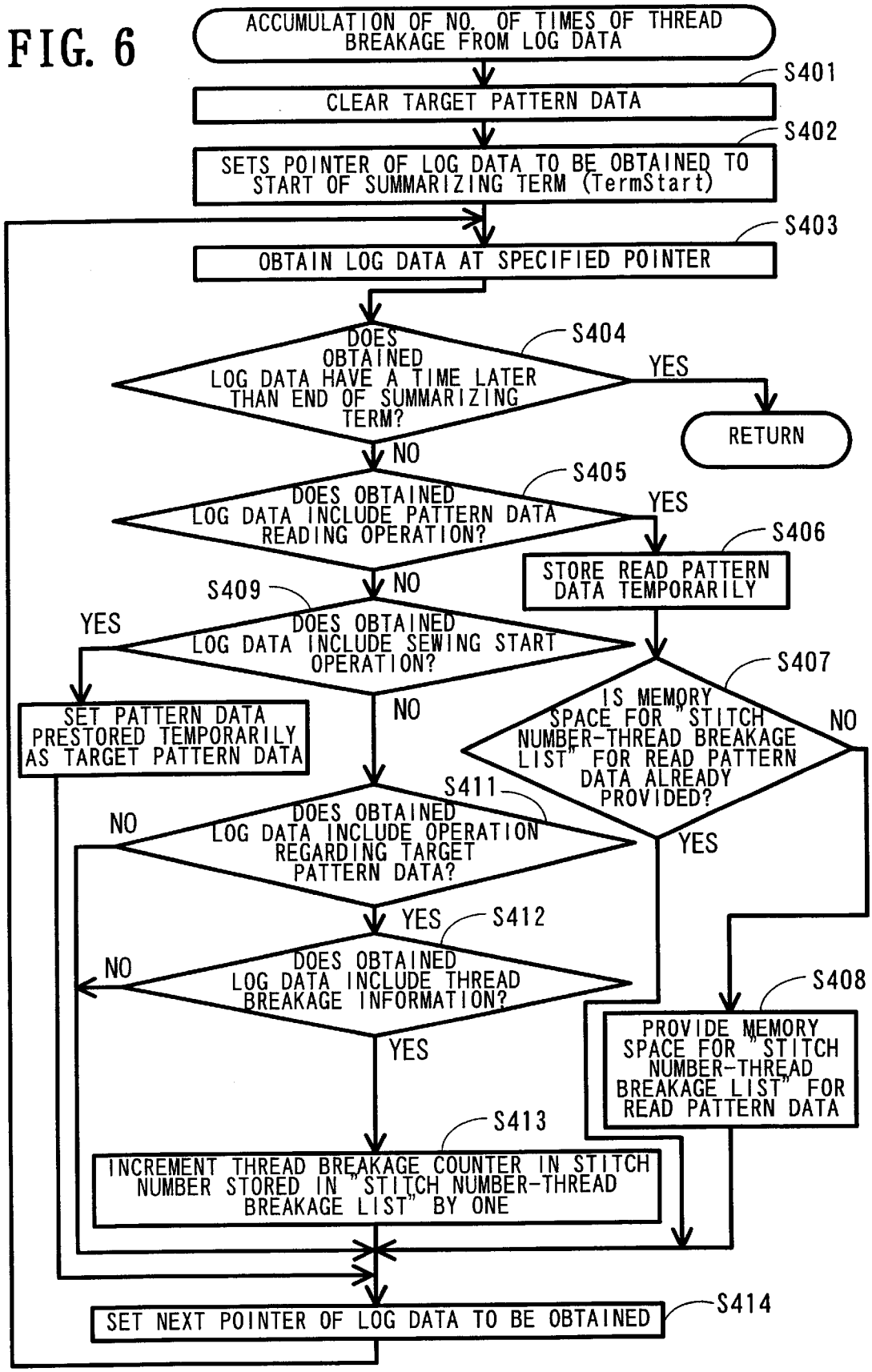
FIG. 6 is a flowchart of a program for accumulating the number of times thread breakage occurs.

In S140 of the main routine, a subroutine of accumulating the number of times of thread breakage from log data is performed, as shown in FIG. 6. When this subroutine is executed, the computer 1 clears target pattern data (S401). The computer 1 then sets a pointer of log data to be obtained to the start of the summarizing term of the thread breakage information (TermStart). This information was obtained in the subroutine of selecting a term for summarizing the thread breakage information (S402). Log data is read and processed in order from a line indicated by the obtained pointer.

The computer 1 reads the log data at the pointer set at S402 (S403). The computer 1 determines whether the read log data has a time later than the end of the term for summarizing the thread breakage information obtained in the subroutine of selecting a term for summarizing the thread breakage information (S404). When the data has a time equal to, or later than the end of the term for summarizing the thread breakage information, the computer 1 finishes the subroutine and returns to the main routine. At this time, the computer 1 determines "no" at S404 because the summarizing is just started, and goes to S405. From this step onward, the contents of the log data read at S403 are checked. The computer 1 determines whether the log data read at S403 includes a pattern data reading operation (S405), a sewing start operation (S409), a target pattern-related operation (S411), or thread breakage information (S412). When the log data does not include any of the above (S405, S409, S411, S412: No), the computer 1 advances the log data pointer by one line (S414) and reads log data at the next pointer (S403).

The computer 1 determines whether the read log data includes a pattern data reading operation (S405). When it includes the pattern data reading operation (S405: Yes), the computer 1 stores the read pattern data temporarily (S406). Because thread breakage information needs to be summarized according to pattern data, the computer 1 determines whether a memory space for a stitch number-thread breakage list for the read pattern data is provided (S407). When the pattern data is read for the first time (S407: No), a memory space is provided for a stitch number-thread breakage list for the pattern data (S408). The computer 1 advances the log data pointer by one line (S414) and reads log data at the next pointer (S403). When the read log data does not include the pattern data reading operation (S405: No), the computer 1 goes to a next step.

When the read log data includes the sewing start operation (S409: Yes), the computer 1 sets the pattern data temporarily pre-stored as the target pattern data (S410). In this step, the computer 1 only reads the pattern data and excludes the non-embroidering operation. The read pattern is not regarded as a target pattern until embroidering is started. The computer 1 advances the log data pointer by one line (S414), and reads log data at the next pointer (S403). When the read log data does not include the sewing start operation (S409: No), the computer 1 goes to a next step.

The computer 1 determines whether the obtained log data includes an operation regarding the target pattern data set at S410 (S411). At this time, log data related to preparation before sewing and log data irrelevant to the target pattern data are excluded. When the log data does not include the operation regarding the target pattern data (S411: No), the computer 1 advances the log data pointer by one line (S414), and reads log data at the next pointer (S403). When it includes the operation regarding the target pattern data (S411: Yes), the computer 1 determines whether the log data includes thread breakage information (S412). When it does not include thread breakage information (S412: Yes), the computer 1 adds thread breakage information to the stitch number-thread breakage list associated with the target pattern data. In other words, the computer 1 reads a stitch number where the thread breakage occurred from the log data, and increments a thread breakage counter in the stitch number by one (S413). Further, the computer 1 advances the log data pointer by one (S414), and reads log data at the next pointer (S403).

The computer 1 reads and processes log data one after another in the above manner. When the computer 1 reads log data to the end of the term for summarizing (S404: Yes), it finishes the subroutine and returns to the main routine. An example of the stitch number-thread breakage list created in this manner is shown in FIG. 10. This list is created based on a pattern having 24 stitches in total and includes information such as an attribute, a stitch length, and the number of times thread breakage has occurred to each stitch. The attribute and the stitch length are derived from pattern data.

Figure 7:
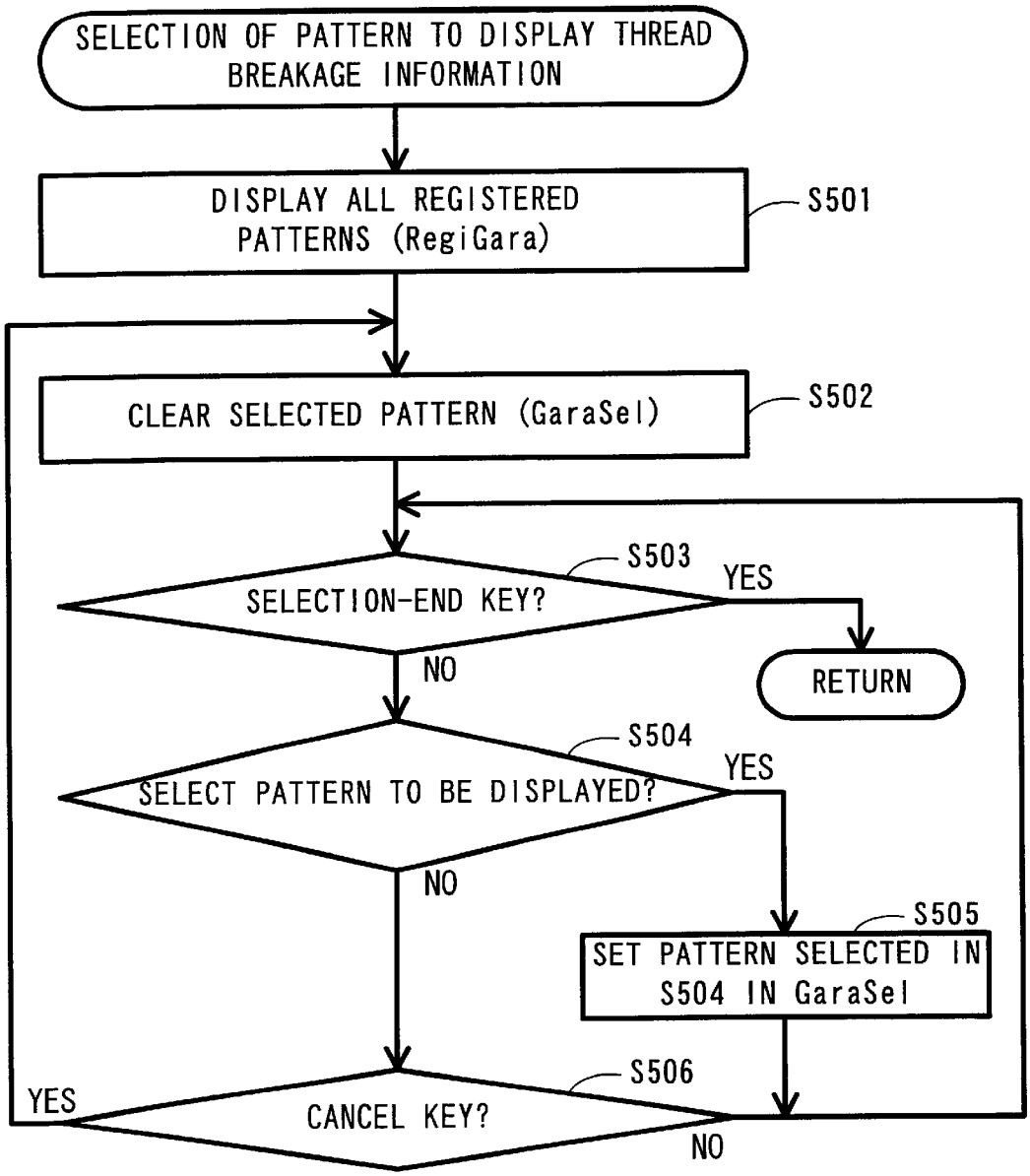
FIG. 7 is a flowchart of a program for selecting thread breakage information pertaining to a particular pattern.

In S150 of the main routine, a subroutine of selecting a pattern to display the thread breakage information is performed, as shown in FIG. 7. When this subroutine is executed, the computer 1 displays all registered patterns (RegiGara) on the CRT 13 (S501). A registered pattern is a pattern obtained in the subroutine of accumulating the number of thread breakage occurrences from the log data. Then, the computer 1 clears a selected pattern area (GaraSel) (S502).

The computer 1 determines whether a selection-end key is pressed by the user (S503). When the selection-end key is pressed (S503: Yes), the computer 1 finishes the subroutine and returns to the main routine. Alternatively, the computer 1 may determine whether a pattern to be displayed is selected by the user (S504). When the pattern is selected (S504: Yes), the computer 1 sets information of the selected pattern in the selected pattern area (GaraSel) (S505). Alternatively, the computer 1 may determine whether the cancel key is pressed by the user (S506). When the cancel key is pressed (S506: Yes), the computer 1 clears the contents in the selected pattern (GaraSel) (S502) and waits for a key entry. When the selected pattern is set in this manner and the selection-end key is pressed (S503: Yes), the computer 1 finishes the subroutine and returns to the main routine.

Figure 8:
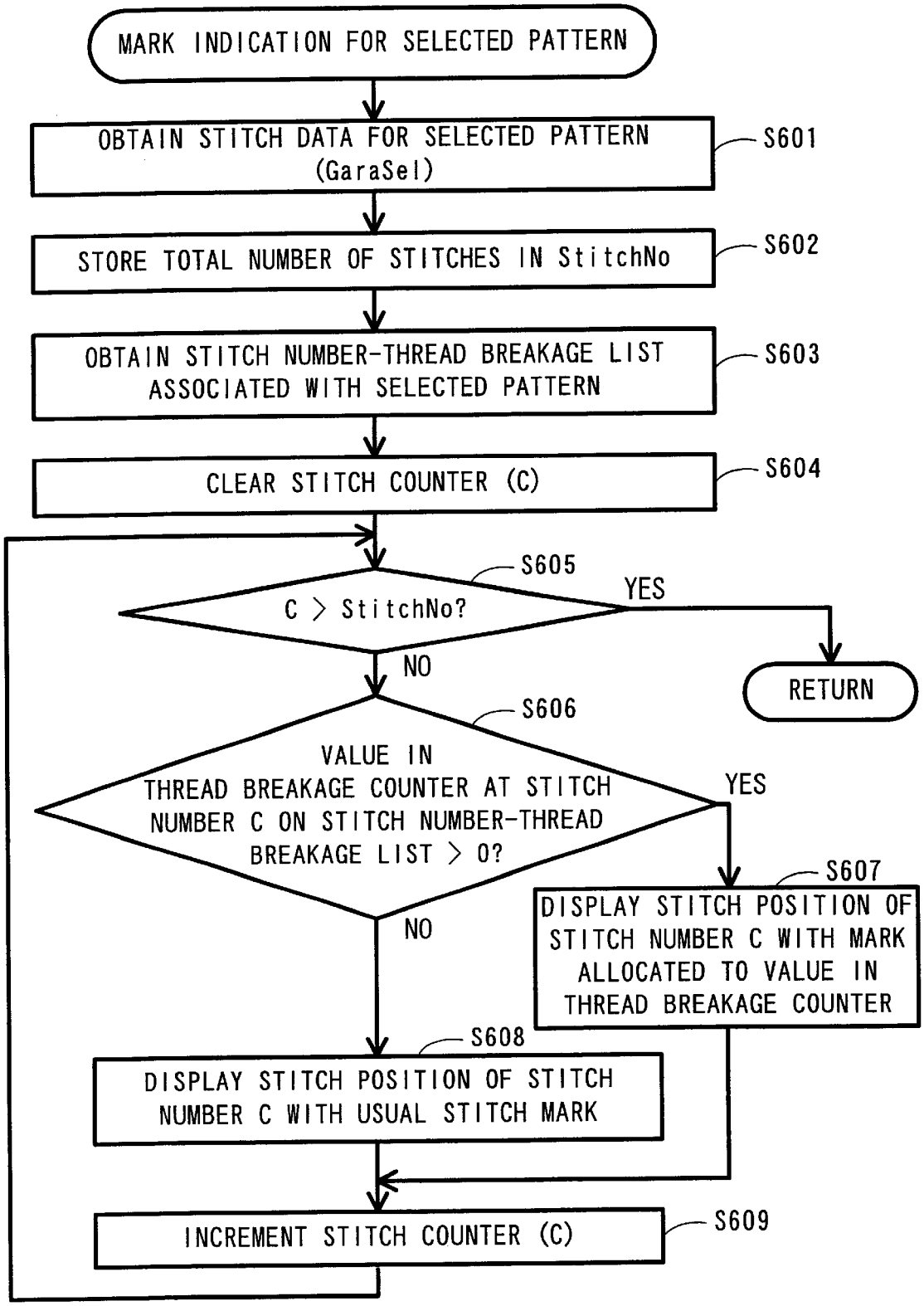
FIG. 8 is a flowchart showing a program for displaying thread breakage information by marks.
Figure 9:
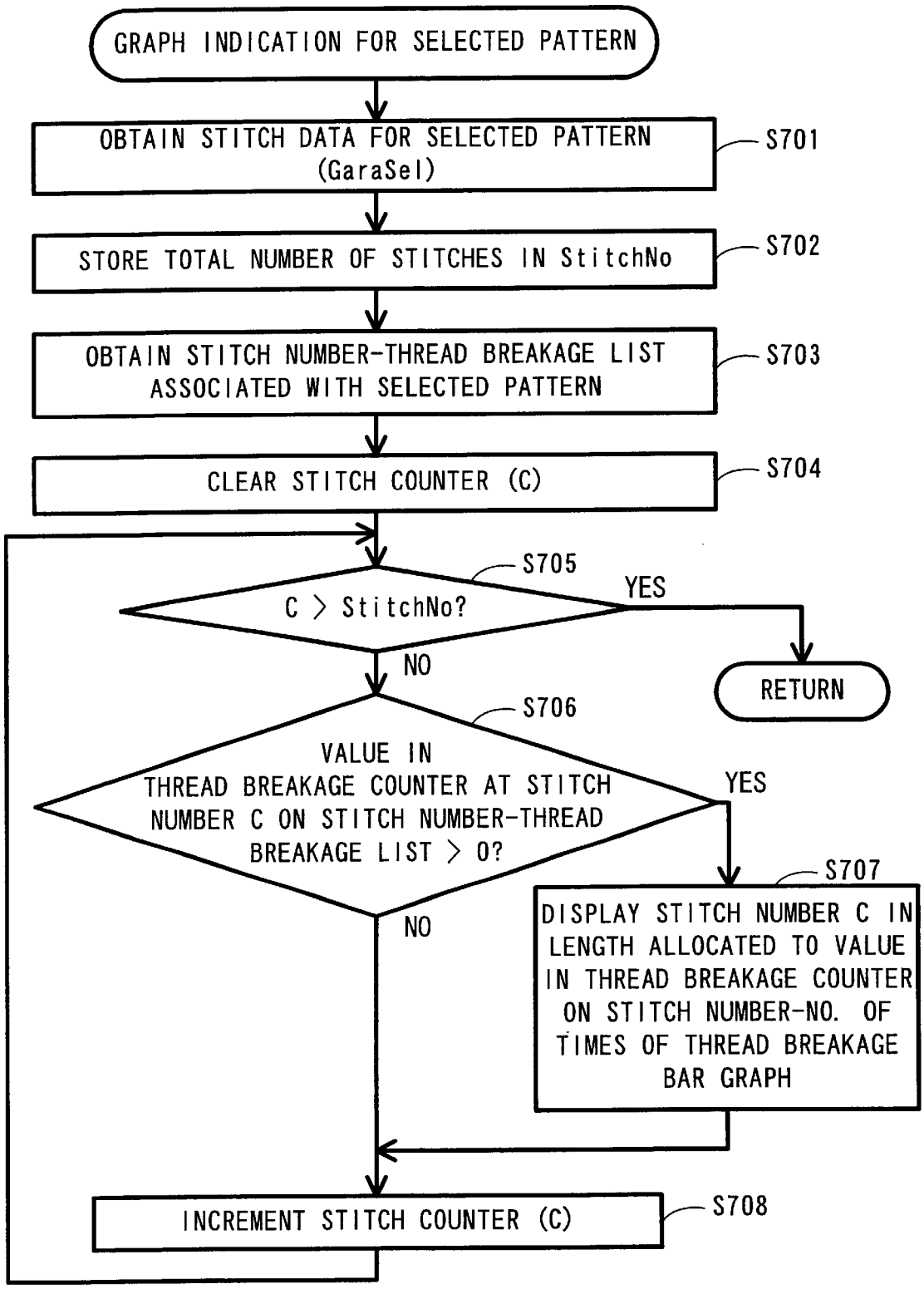
FIG. 9 is a flowchart showing a program for displaying the thread breakage information by a graph.

In the main routine, when the mark indication is selected (S155: Yes in FIG. 3), a subroutine of displaying thread breakage information of a selected pattern by mark indication is performed, as shown in FIG. 8. When this subroutine is executed, the computer 1 obtains stitch data for the pattern selected in the subroutine of selecting a pattern to display thread breakage information (S601). The stitch data represents each stitch position in the embroidery pattern and is used as pattern data during sewing.

The computer 1 stores the total number of stitches of the selected pattern in a stitch number storage area (StitchNo) (S602). Then, the computer 1 obtains a stitch number-thread breakage list associated with the selected pattern from the log data (S603). The computer 1 clears a stitch counter (C) (S604) in increments until it is equal to the total number of stitches stored in the stitch number storage area (StitchNo) (S605), while performing the following steps.

The computer 1 looks up a stitch number with the same number as the stitch counter (C) (hereinafter referred to as a stitch number C), on the stitch number-thread breakage list and determines whether the stitch number C includes a value in the thread breakage counter indicating the number of thread breakage occurrences (S606). If the value in the thread breakage counter is greater than zero (S606: Yes), the computer 1 displays a stitch position indicated by the stitch number C with a thread breakage mark allocated to the value in the thread breakage counter on the CRT 13 (S607). In FIG. 11, for example, a mark "X" represents a place where thread breakage occurred once, a mark "●" represents a place where thread breakage occurred two or three times, and a mark "◆" represents a place where thread breakage occurred more than four times. If thread breakage reoccurred within two stitches succeeding the stitch where thread breakage occurred, it is regarded as a thread breakage-prone area, which can be displayed emphatically, for example, by blinking.

Alternatively, if the value in the thread breakage counter at the stitch number C is 0 (S606: No), the computer 1 displays the stitch position with a usual stitch mark on the CRT 13 (S608). The computer 1 increments the stitch counter (C) (S609), and checks on the value in the thread breakage counter at a consecutive stitch number C. When the computer 1 displays all stitches on the CRT 13 (S605: Yes) in the above manner, it finishes the subroutine and returns to the main routine.

Figure 12:
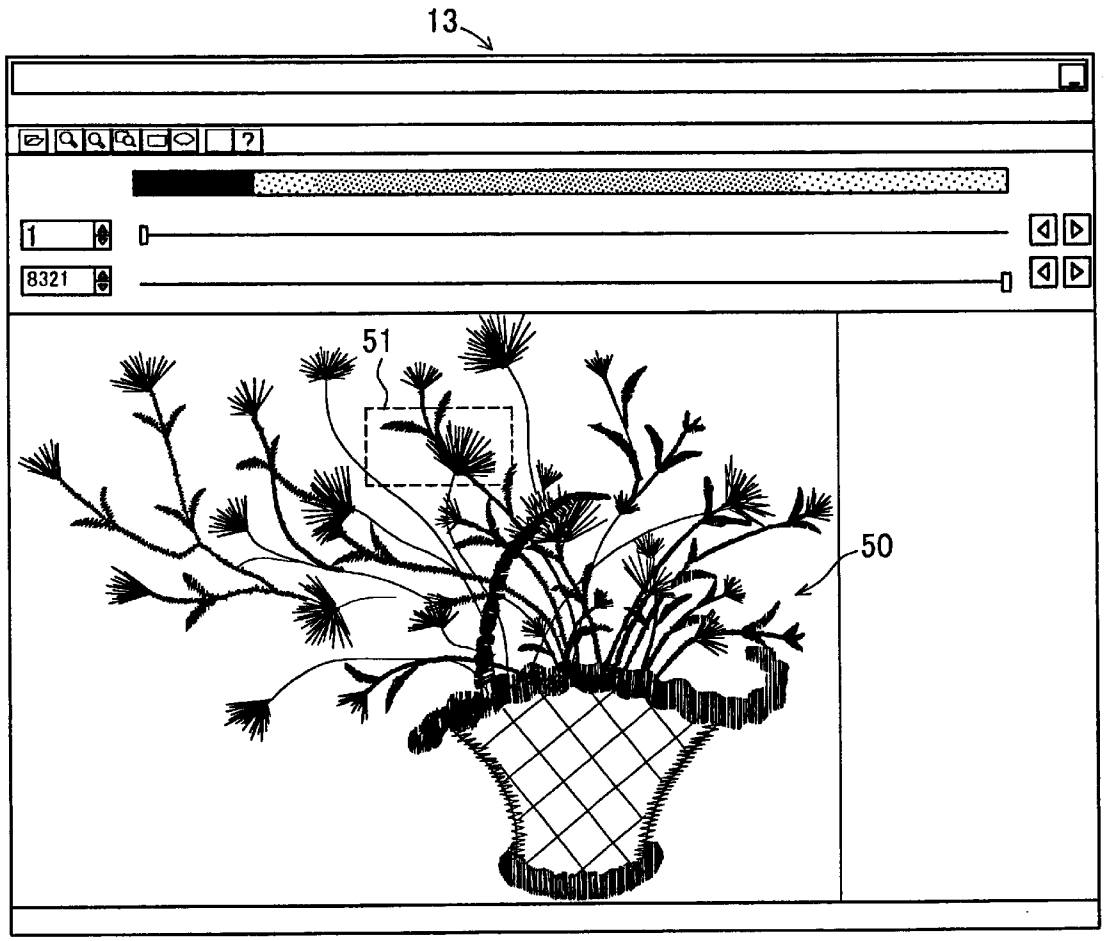
FIG. 12 shows an embroidery pattern with a graphic representation of thread breakage marks.
Figure 13:
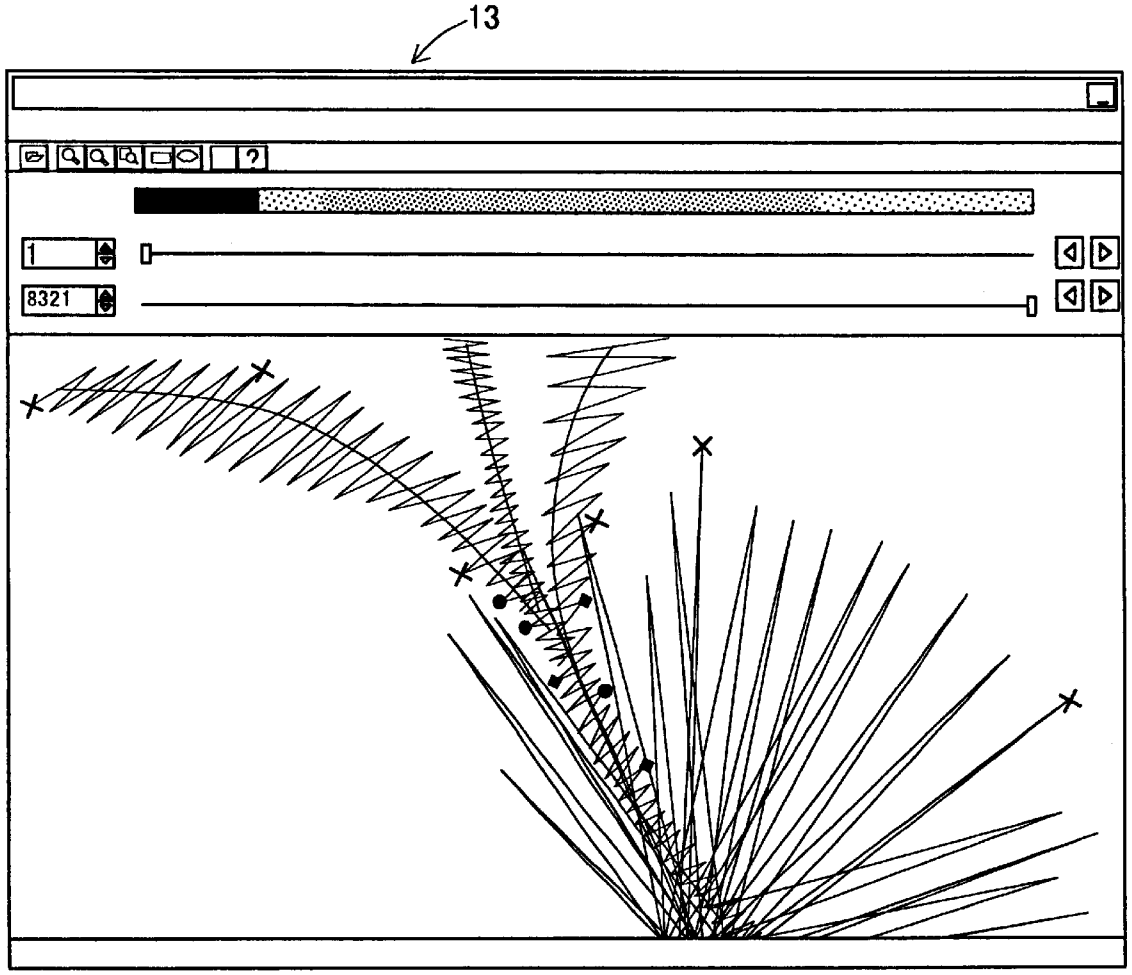
FIG. 13 shows a partially enlarged view of the embroidery pattern for thread breakage marks.

Examples of mark indications are shown in FIGS. 12 and 13. FIG. 12 shows a broad view of a pattern 50 displayed on the CRT 13, and FIG. 13 shows an enlarged view of a part of the pattern 50 displayed on the CRT 13 with thread breakage marks. Since a positional relationship among each stitch is not displayed precisely in FIG. 12, a range 51, for example, is enlarged as shown in FIG. 13. Such an enlarged view enables dense stitch positions to be displayed and allows the user to easily locate thread breakage occurrences by the displayed thread breakage marks. When it is still difficult to find such places, the portion can be displayed in a further enlarged view. By placing the thread breakage marks at places where thread breakage occurred, it is easy to find a place where thread breakage is likely to occur during embroidery operations. This information can be utilized as management data for later embroidery operations.

In the main routine, when the mark indication is not selected (S155: NO in FIG. 3), a subroutine is performed in S170 of displaying thread breakage information of a selected pattern by a graph, shown in FIG. 9. The computer 1 obtains stitch data for the pattern selected in the subroutine of selecting a pattern to display the thread breakage information (S701). The stitch data represents each stitch position in the embroidery pattern and is used as pattern data during embroidering.

The computer 1 stores the total number of stitches of the selected pattern in a stitch number storage area (StitchNo) (S702). Then, the computer 1 obtains a stitch number-thread breakage list associated with the selected pattern from the log data (S703). The computer 1 clears a stitch counter (C) (S704), in increments until it is equal to the total number of stitches stored in the stitch number storage area (StitchNo) (S705), while performing the following steps.

The computer 1 looks up a stitch number with the same number as the stitch counter (C) (hereinafter referred to as a stitch number C), on the stitch number-thread breakage list, and determines whether the stitch number C includes a value in the thread breakage counter indicating the number of times of thread breakage (S706). If the value in the thread breakage counter is greater than zero (S706: Yes), the computer 1 displays the stitch number C on the CRT 13. The stitch number is represented in a length allocated to the value in the thread breakage counter on a bar graph that represents a relationship between the stitch number and the number of times of thread breakage (S707). The computer 1 increments the stitch counter (C) (S708), and checks on the value in the thread breakage counter at a consecutive stitch number C. When the computer 1 checks all stitches in this manner (S705: Yes), it finishes the subroutine and returns to the main routine.

Figure 14:
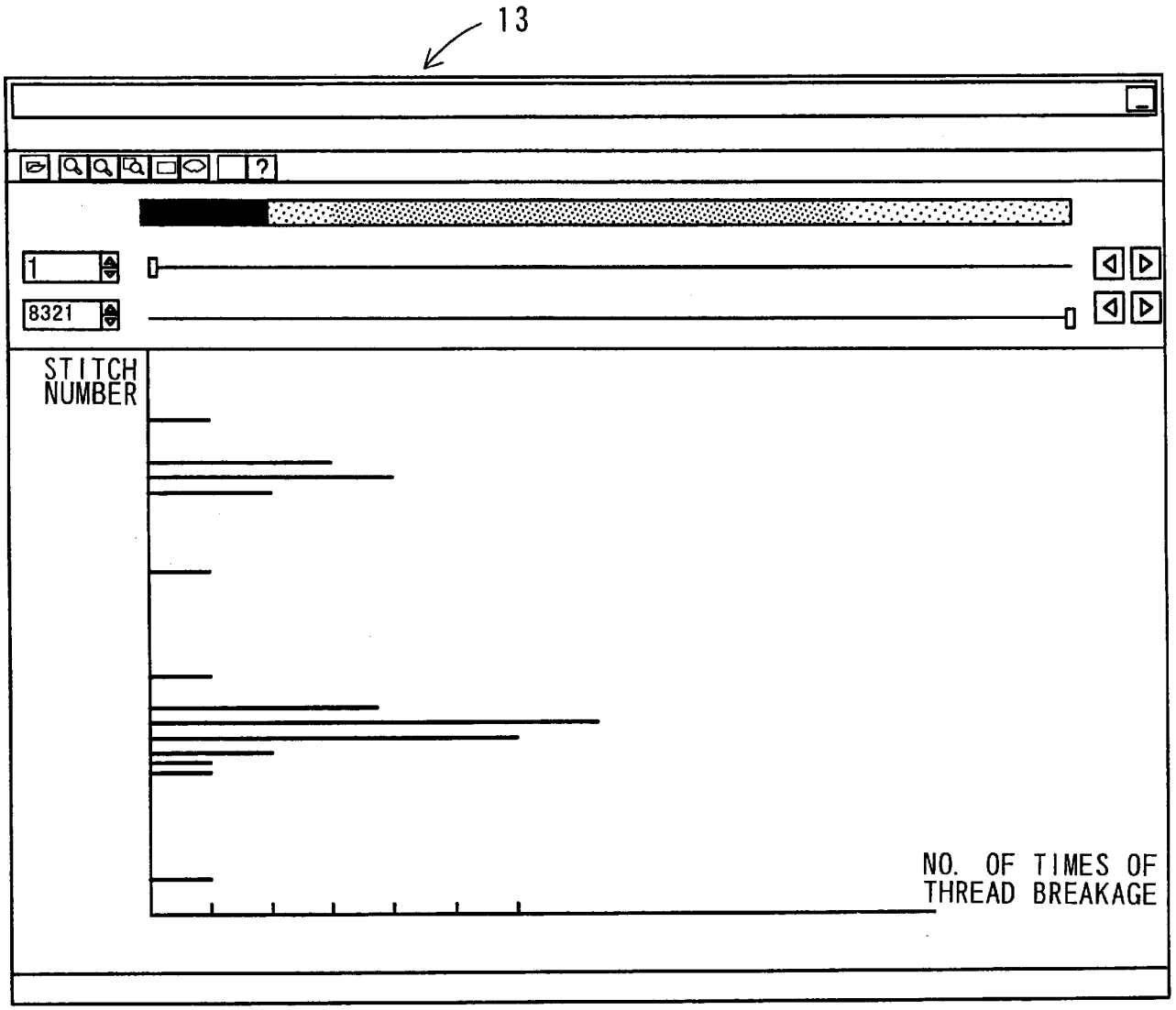
FIG. 14 is an exemplary illustration of a thread breakage graph.
Figure 16:
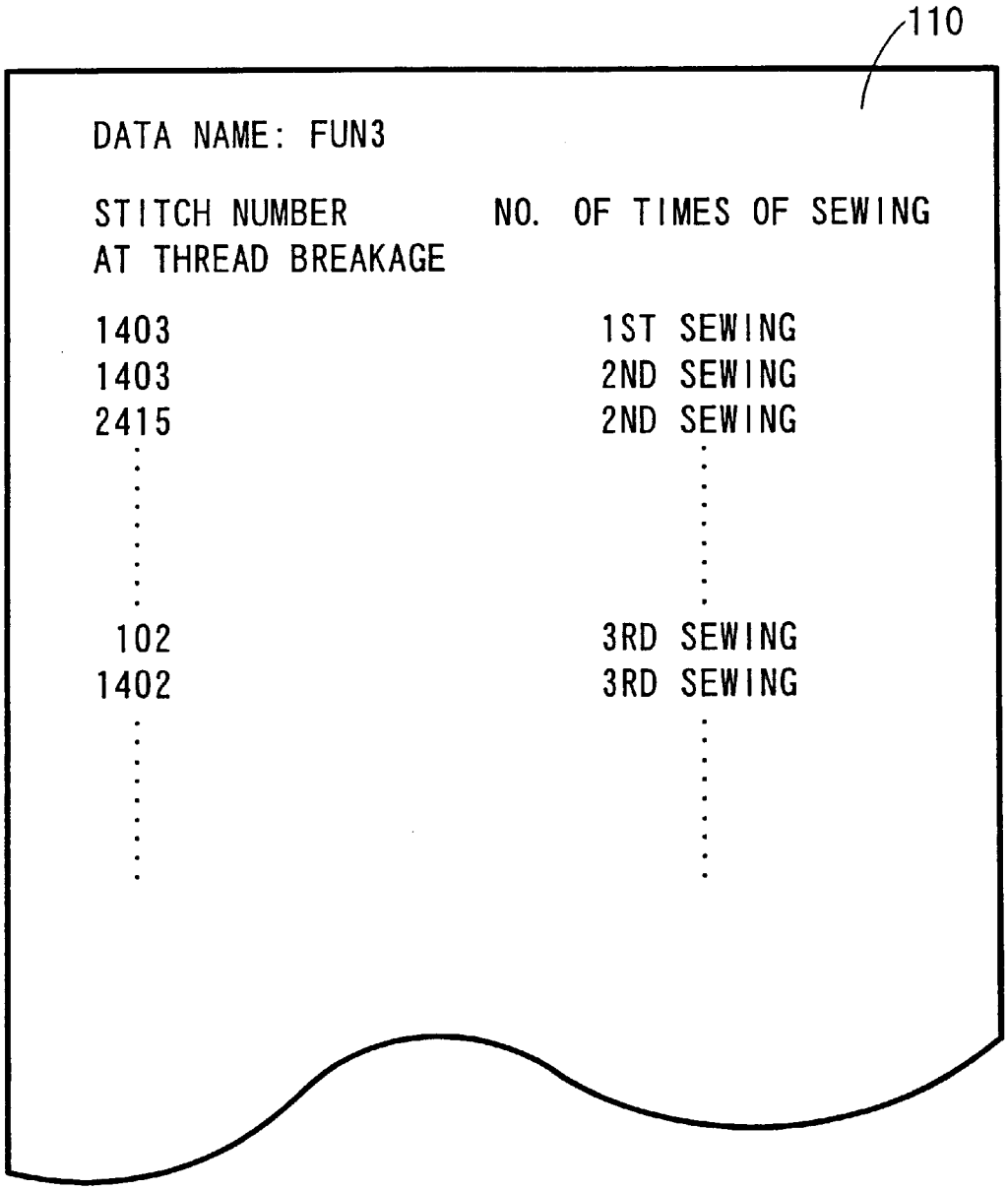
FIG. 16 is an example of a thread breakage count table of the prior art.

An example of the graph indication is shown in FIG. 14. The number of thread breakage occurrences is represented by a bar graph in association with each stitch. In one embodiment, the number of thread breakage occurrences may be color-coded according to three levels of once, twice or three times, and more than four times, so that a concentration of these places may be viewed easily. In this way, the thread breakage information is summarized from the log data, including operation state data allocated for a set period of time, and displayed on the CRT 13 in viewable methods, such as the mark indication on an embroidery pattern and a graph. Such viewable methods help the user to perform embroidering operations later.

As described above, according to the operation data processing device employed in the pattern sewing machine system, places where thread breakage occurred can be displayed with marks on an embroidery pattern on the CRT 13. Because the places where thread breakage occurred can be displayed more easily by changing the marks according to the number of thread breakage occurrences, the thread breakage information may be utilized for later production control. Further, the thread breakage information may be represented by a graph. Depending on a given condition, for example, a complicated embroidery pattern with dense stitches, the device of this invention allows the thread breakage information to be displayed in a way that facilitates better use of the information.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

For example, in the above embodiment, mark shapes are changed according to the number of times of thread breakage. However, an embroidery pattern can be displayed in gray so that marks can be displayed in different colors according to the number of times of thread breakage.

What is claimed is:

1. An operation data processing device that processes operation data for pattern sewing operations performed by at least one pattern sewing machine, comprising:

a log data storing device that makes and stores log data based on an operation state of the at least one pattern sewing machine;

a trouble summarizing device that summarizes trouble information on sewing, which occurred on the at least one pattern sewing machine during operation, in association with a stitch number based on the log data stored in the log data storing device; and a displaying device that visualizes the trouble information summarized via the trouble summarizing device in association with the stitch number.

2. The operation data processing device according to claim 1, wherein the displaying device shows the trouble information with a predetermined mark.

3. The operation data processing device according to claim 2, wherein the pattern sewing machine creates a sewing pattern and the mark is displayed on a position of the sewing pattern, which corresponds to the stitch number summarized by the trouble summarizing device.

4. The operation data processing device according to claim 2, wherein the mark is changed according to a number of trouble occurrences.

5. The operation data processing device according to claim 2, wherein the mark is displayed in a specified display manner when a second trouble occurs within a plurality of stitches succeeding a stitch where a first trouble occurred.

6. The operation data processing device according to claim 1, wherein the displaying device displays the stitch number in association with the number of trouble occurrences.

7. The operation data processing device according to claim 1, wherein the trouble information is thread breakage information.

8. The operation data processing device according to claim 5, wherein the mark blinks in the specified display manner.

9. An operation data processing device comprising:

at least one sewing machine that creates a sewing pattern;

a log data generating device that generates log data for operations in creating the sewing pattern by the sewing machine;

a log data storing device that stores the log data generated by the log data generating device;

a trouble information selecting device that selects trouble information on sewing, which occurred during operations in creating the sewing pattern, from the log data stored in the log data storing device;

a stitch number counting device that counts a stitch number for a fixed period of time to create the sewing pattern;

a trouble information summarizing device that summarizes the trouble information selected by the trouble information selecting device, in association with the stitch number counted by the stitch number counting device; and a displaying device that displays the trouble information summarized by the trouble information summarizing device.

10. The operation data processing device according to claim 9, wherein the displaying device displays a predetermined mark in association with the stitch number on the sewing pattern made by the sewing machine.

11. The operation data processing device according to claim 10, wherein the trouble information summarizing device counts the number of trouble occurrences during a sewing operation and the mark displayed by the displaying device is changed according to the number of trouble occurrences.

12. The operation data processing device according to claim 9, wherein the trouble information summarizing device counts the number of trouble occurrences according to each sewing pattern, and the displaying device displays the number of trouble occurrences in association with the stitch number in a graph.

13. The operation data processing device according to claim 9, wherein the trouble information selected by the trouble information selecting device is thread breakage information.

14. A method of processing data, comprising the steps of:

making a sewing pattern by a sewing machine;

counting a stitch number of a specified sewing pattern made in the step of making the sewing pattern;

generating log data for a series of operational histories involved in sewing operations performed in the step of making the sewing pattern;

detecting a thread breakage occurrence in association with the stitch number from the operational histories made in the step of generating log data; and displaying the thread breakage occurrences detected in the detecting step.

15. The method of claim 14, wherein the stitch number is counted from a first stitch of the specified sewing pattern in the counting step and the thread breakage occurrence is displayed in association with the stitch number counted from the first stitch.

16. The method of claim 14, wherein the number of thread breakage occurrences is detected in the step of generating log data, a stitch number is counted at the first stitch of the specified sewing pattern in the counting step, and the number of thread breakage occurrences is displayed according to the stitch number in the displaying step.

17. The method of claim 16, wherein in the displaying step, a predetermined display mark is displayed and changed according to the number of the thread breakage occurrences.

18. The method of claim 15, wherein in the displaying step, a predetermined display mark is displayed on a created sewing pattern according to the number of stitches.

19. The method of claim 10, wherein in the displaying step, the predetermined mark on the sewing pattern is enlarged.

* * * * *